US005373958A

United States Patent [19]

Bokmiller

[11] Patent Number: 5,373,958

[45] Date of Patent: Dec. 20, 1994

[54] PLASTIC CONTAINER WITH THREADED CLOSURE

[75] Inventor: David J. Bokmiller, Hudson, Ohio

[73] Assignee: Lobo Containers, Inc., Eldorado, Ark.

[21] Appl. No.: 36,152

[22] Filed: Mar. 24, 1993

[51] Int. Cl.[5] ..... B65D 17/52

[52] U.S. Cl. ..... 220/284; 220/304; 220/608; 220/675; 215/331; 206/519

[58] Field of Search ..... 220/288, 908, 284, 23.83, 220/23.6, 521, 215, 304, 669, 675, 672, 608; 215/331; 206/515, 520, 596, 519

[56] References Cited

U.S. PATENT DOCUMENTS

| | | | |
|---|---|---|---|
| 2,633,264 | 3/1953 | Dinsmore et al. . | |
| 3,438,538 | 4/1969 | Peters . | |
| 3,474,843 | 10/1969 | Maris | 220/288 X |
| 3,477,631 | 11/1969 | Dunlap, Jr. et al. | 206/596 |
| 3,521,777 | 7/1970 | Vik | 206/596 X |
| 4,014,452 | 3/1977 | Galer . | |
| 4,453,647 | 6/1984 | Neat . | |
| 4,558,796 | 12/1985 | Jaicks . | |
| 4,666,054 | 5/1987 | Jaicks . | |
| 4,708,258 | 11/1987 | Shaw et al. | 220/288 |
| 4,930,632 | 6/1990 | Eckert et al. | 206/520 X |
| 5,096,083 | 3/1992 | Shaw et al. | 220/288 X |
| 5,180,076 | 1/1993 | Hundt | 220/288 X |

*Primary Examiner*—Allan N. Shoap
*Assistant Examiner*—Jes F. Pascua
*Attorney, Agent, or Firm*—Carothers & Carothers

[57] ABSTRACT

A plastic blow molded containr and lid combination wherein the double-walled lid is screwed to the top of the container and a parallel pair of horizontal recesses are provided on opposite sides of the container wall for receiving forks of a forklift for lifting and otherwise manipulating the container with a conventional forklift. The bottom of the container is also provided with forklift access recesses for lifting and manipulating the container from the bottom with a conventional forklift. The underside of the lid is provided with a protrusion for engaging the upper end of a salvage drum within the container to confine the drum between the top and bottom of the container. An override lid lock mechanism is provided to prevent the lid from accidentally unthreading itself. In addition, central portions of the bottom of the container are recessed upwardly with respect to perimeter portions of the container bottom so that the container in an empty condition will stably rest on a surface without easily tipping. The container and lid are blow molded of high density/high molecular weight thermoplastic such as polyethylene.

26 Claims, 3 Drawing Sheets

PLASTIC CONTAINER WITH THREADED CLOSURE

BACKGROUND OF THE INVENTION

The present invention relates generally to containers and more particularly to plastic containers with threaded closures for containing hazardous materials and the like.

Polyethylene containers are utilized for containing hazardous materials either in free form or as an over packing for metal salvage drums containing hazardous materials. An example of such a container is illustrated in U.S. Pat. No. 4,708,258 issued on Nov. 24, 1987 for SALVAGE DRUM.

This drum-type container is corrosion resistant. Such containers must also have mechanical strength combined with light weight, and they must provide safe containment of hazardous materials without leaking, despite rough handling during transportation.

Such containers must be approved in the United States by the U.S. Department of Transportation (DOT). The rigorous DOT testing requires dropping of a container, generally filled with water, from a specified height onto a concrete slab, and the angle at which the container is dropped onto the concrete is varied for the testing procedure. Such containers are also usually provided in a stackable form so that the containers can be stacked either on top of each other when full or stacked by nesting them into each other when empty. In addition, the lids are usually attached by a threaded connection to provide maximum leak-proof capabilities.

The salvage container described in U.S. Pat. No. 4,708,258 is very effective. However, it is a principal object of the present invention to provide such a container with additional novel improvements which will make such a container even mechanically stronger, more affordable, more suitable for containing hazardous materials in a leak-tight manner and more suitable for manipulating, handling, transporting and storing the containers.

The prior art salvage container described, is specifically designed for spin or rotational molding, instead of blow molding, from a linear low or medium density polyethylene, which inherently makes the container more expensive to manufacture and not as strong as if the container and lid were blow molded of high density/high molecular weight thermoplastic.

In addition, such prior art containers intended for containment of conventional 55 or 95 gallon drums are not provided with a means for securely engaging and confining the salvage drum within the container between the bottom of the container and the underside of the lid when the lid is fully received on the container. In addition, such prior art containers do not provide a secure and easy means for manipulating the containers with a conventional forklift.

It is an object of the present invention to eliminate these disadvantages and thereby provide a blow molded container with a hollow closure therefore which has all of the aforedescribed advantages of more mechanical strength, affordability, suitability for leak-tight containment, and convenience of manipulation for handling and transportation purposes.

SUMMARY OF THE INVENTION

The blow molded container and hollow closure combination of the present invention includes a plastic container and lid wherein the container has a side wall and circular bottom wall. The side wall of the container also has an upper side wall portion, a lower side wall portion, and an enlarged diameter side wall portion intermediate the upper and lower side wall portions.

The exterior surface of the upper side wall portion is provided with male threads.

The lid is double-walled and has a double-walled top body and a double-walled annular skirt depending downwardly from the top body. The interior circumferential surface of the skirt is provided with female threads for mating with the male threads on the container.

The container is presized to precisely contain a salvage drum therein, such as a conventional steel 55 or 95 gallon drum, and the container with its lid is designed for engaging and confining such a salvage drum in the container between the bottom and the lid when the lid is threadably received on the container.

This drum retention device is provided in the form of a downwardly extending protrusion on the underside of the lid which engages the upper end of the salvage drum received within the container, when the lid is fully screwed down on the container. This protrusion is preferably provided in the shape of an annular ring.

This annular protrusion is slightly larger in diameter than the top of the drum contained within the container and it further includes an inwardly sloped or tapered annular wall for engaging the upper perimeter of the drum so that the drum is tightly contained between the lid and the inside bottom of the container.

An override lid locking mechanism is also provided between the bottom of the lid skirt and the container top for locking the lid onto the container when the lid is fully threaded thereon. This override locking mechanism consists of protruding lock ramps that are received in corresponding lock notches or recesses. For example, small lock ramps may protrude upwardly from the top side of the container and a number of corresponding notches or recesses are provided in the bottom of the threaded skirt so that when the lid is threaded onto to the container these ramp surfaces will snap into respective notches in the bottom of the lid skirt.

In addition, center portions of the bottom of the container are molded such that they are upwardly recessed with respect to perimeter portions of the bottom of the container, so that when the container is empty only these perimeter portions of the container bottom will rest on the ground or underlying surface. This stabilizes the containers so that they will readily rest in an upright position when they are in an empty condition.

Also, a parallel pair of horizontal recesses are provided on opposite sides of the container in the exterior surface of the enlarged diameter center side wall portion. These recesses are provided for receiving forks of a forklift for lifting and moving the container by forklift in an empty of full condition.

The bottom of the container is also provided with a pair of forklift recesses for receiving forks of a forklift, thereby providing even additional means for readily manipulating the container by conventional forklift.

The lid is also provided with appropriate recesses in the top thereof to seal the bottom of another such container for stacking capabilities. In addition, the top side of the lid is provided with perimetrical upstanding castellations with gaps therebetween for lever access to assist in tightening or loosening of the lid on the container. For example, a two by four may be placed across the lid in the castellation gaps and used as a leverage to turn the lid.

The lower side wall portion of the containers is also tapered outwardly from the bottom wall to the shoulder formed at the bottom of the central enlarged diameter side wall portion of the container to permit the containers to be easily nested, one within the other, when empty for storage of the containers.

The container and hollow closure are blow molded of high density/high molecular weight thermoplastic thereby providing an exceptional strong container and closure combination. The preferred thermoplastic is polyethylene. Rotational casting is therefore completely eliminated and the product of the present invention has a higher strength than those of the prior art for the same wall thickness. In addition, the thermoset cross-linked or non cross-linked materials utilized in the containers of the prior art in rotational casting are such that if a mistake is made the container must be scrapped. This is not true when blow molding the containers of the present invention with high density/high molecular weight polyethylene.

BRIEF DESCRIPTION OF THE DRAWINGS

Other objects and advantages appear in the following description and claims.

The accompanying drawings show, for the purpose of exemplification without limiting the invention or claims thereto, certain practical embodiments illustrating the principals of this invention wherein:

DESCRIPTION OF THE DEFERRED EMBODIMENT

Figure 1:
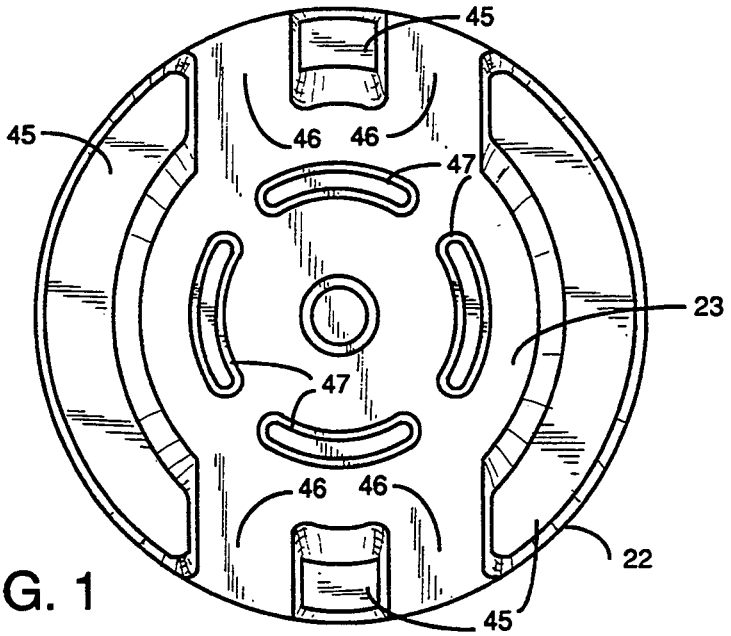
FIG. 1 is a top or plan view of the closure or lid for the plastic container of the present invention.
Figure 2:
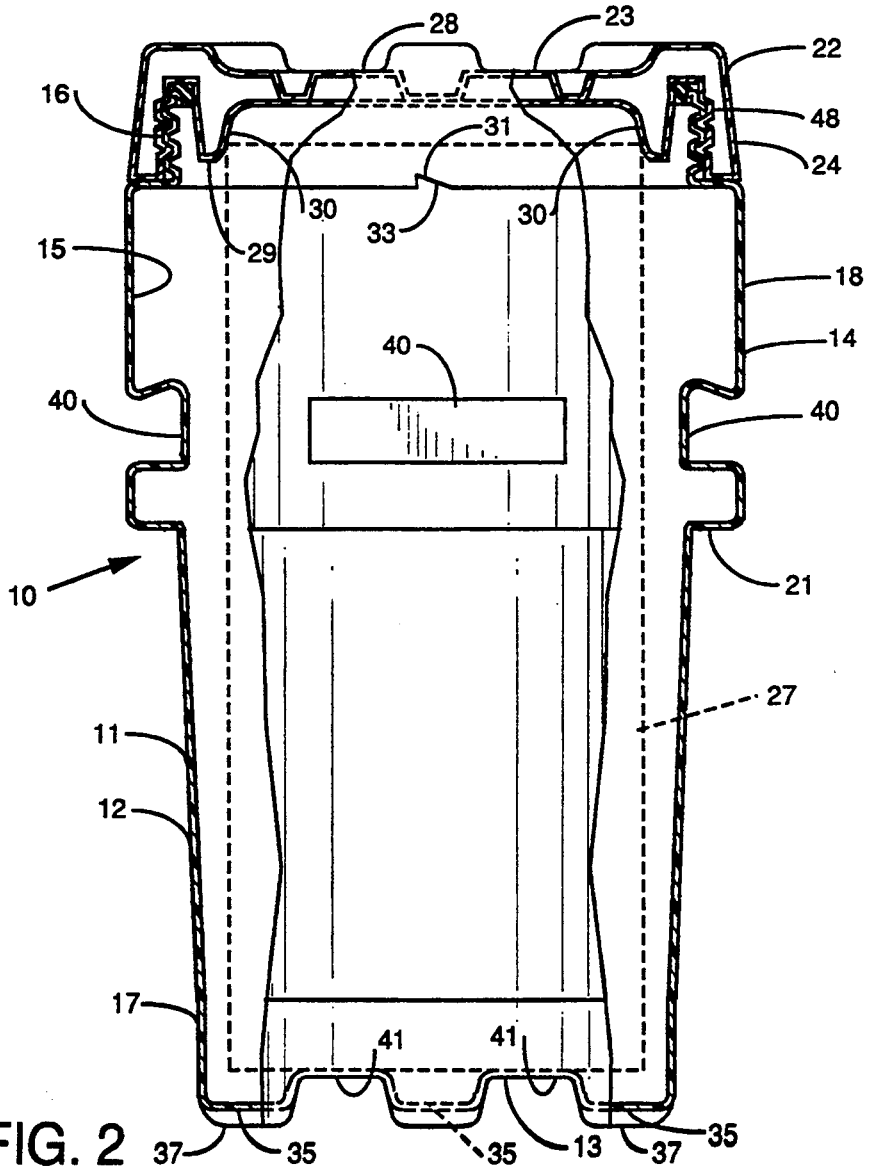
FIG. 2 is a view in side elevation of the plastic container and closure combination of the present invention with portions removed for interior viewing.
Figure 3:
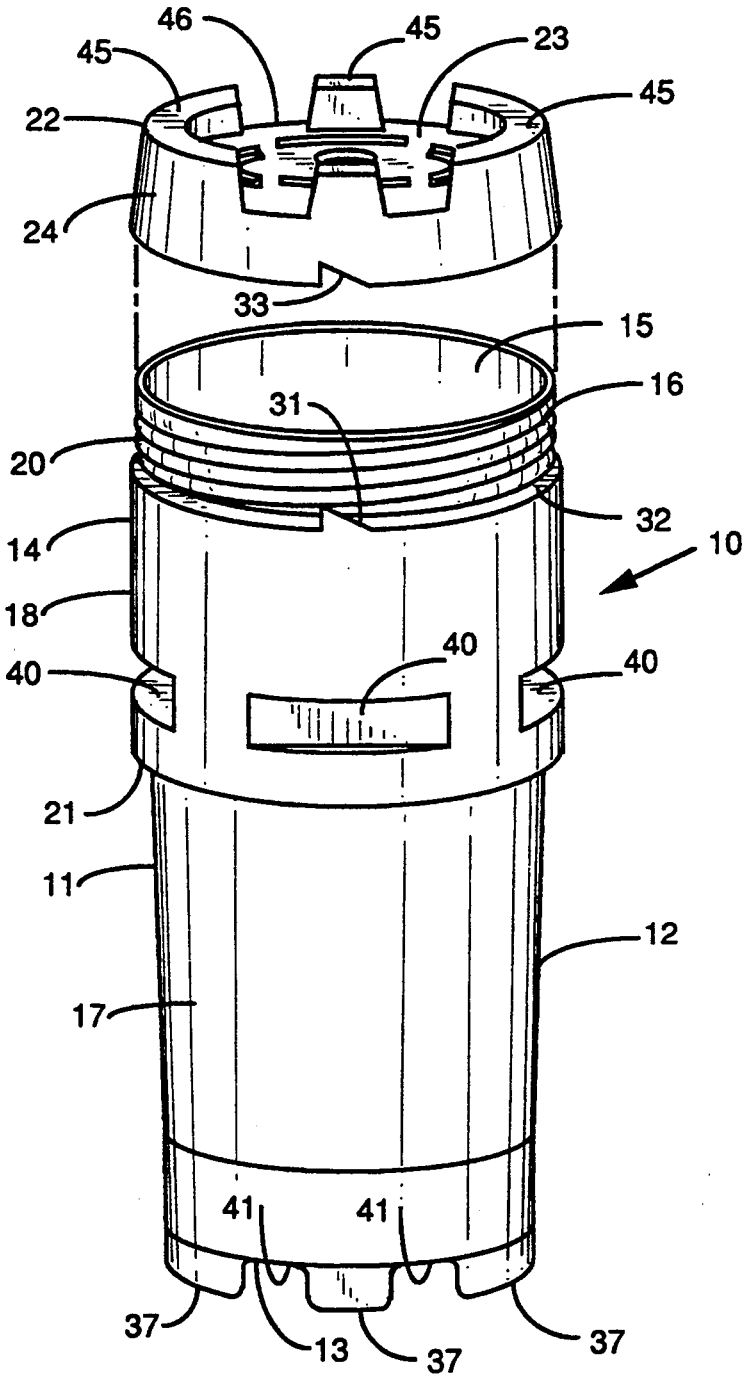
FIG. 3 is a perspective exploded view in side elevation of the plastic closure and lid combination shown in FIG. 2 with the lid removed.

Referring to FIGS. 1, 2 and 3, the blow molded container and hollow closure combination 10 is illustrated. The container portion 11 has a side wall 12 and a circular bottom wall 13. Side wall 12 has an exterior surface 14 and an interior surface 15. Container 11 also has an upper side wall portion 16, a lower side wall portion 17 and an enlarge diameter side wall portion 18, which is intermediate the upper side wall portion 16 and the lower side wall portion 17.

The exterior surface of the upper side wall portion 16 is provided with male threads 20. The container 11 also has an annular shoulder 21 form between the lower side wall portion 17 and the enlarged side wall portion 18.

Lid 22 for container 11 is double-walled as illustrated. Lid 22 has a double-walled top 23 and a double-walled annular skirt 24 depending downwardly from the double-walled top body 23.

Figure 4:
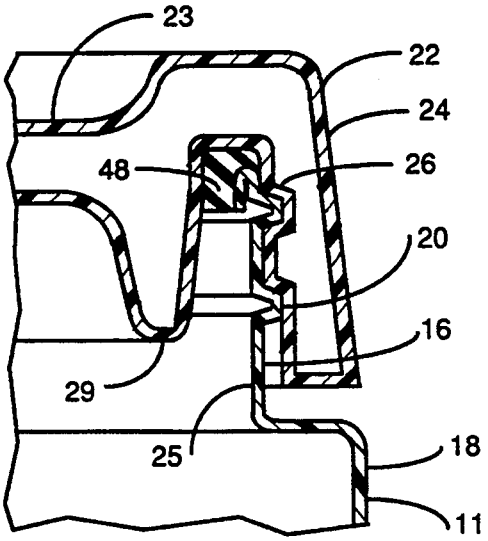
FIG. 4 is an enlarged view in vertical cross-section illustrating a portion of the sealed connection between the lid and container combination of FIG. 2.

Skirt 24 of lid 22 has an interior circumferential surface 25 which is provided with female threads 26 for mating with the male threads 20 of container 11. Details of this arrangement are best illustrated in FIG. 4.

Container 11 is presized to contain a salvage drum therein of conventional size. In this particular instance, container 11 is of such a size that it will container a 95 gallon steel salvage drum 27 therein.

The underside 28 of lid 22 is provided with a downwardly extending annular ring shaped protrusion 29 which engages the upper perimeters 30 of salvage drum 27, such that drum 27 is strictly confined between the inwardly sloped or tapered annular wall 30 of protrusion 29 and the bottom wall 13 of container 11. This prevents drum 27 from moving relative to container 11 when lid 22 is tightly secured thereon.

An override lock mechanism is provided between the bottom of lid skirt 24 and the top of container 11 such that when lid 22 is threadably secured down onto container 11 it cannot accidently back off of its threads. This override lock mechanism is provided by means of protruding lock ramp 31 provided on ledge 32 of container 11 in combination with corresonding lock notch 33 provided in the lower annular rim of lid 22. Then lid 22 is tightly screwed down onto container 11, ramp 31 will eventually slip up into notch 33 of lid 22 and lock the lid 22 onto container 11 thereby preventing accidental back-off or threadable removal of lid 22. Multiple lock ramp and corresponding lock notch combinations may be provided.

The center portions 35 of container bottom 13 are upwardly recessed from the perimetrical portions 37. this makes the container much more stable for sitting in an upright position when empty and maintaining an upright position as the container rests primarily on 3 or more perimeter areas 37, without contact of the underlying surface by the center areas 35. Traditionally, plastic molded containers of this type with some type of extending feet do not readily stand on their own due to the bulging nature of the bottom of the plastic molded product.

Container 11 is also provided with two pairs of horizontal recesses 40 on opposite sides of container 11 in the exterior surfaces of enlarged side wall portion 18. These recesses are provided for receiving the forks of a conventional forklift for lifting and moving the container in an empty or full condition by conventional forklift.

In addition, the bottom 13 of container 11 is also provided with a spaced pair of parallel forklift access recesses 41 which permit reception of parallel forks of a conventional forklift for lifting and moving the container 11 from the bottom.

It should be additionally recognized that the top side 23 olf lid 22 is recessed to receive and seat the bottom 13 of one of the containers 11 thereon for stacking of the containers when they are full.

Figure 5:
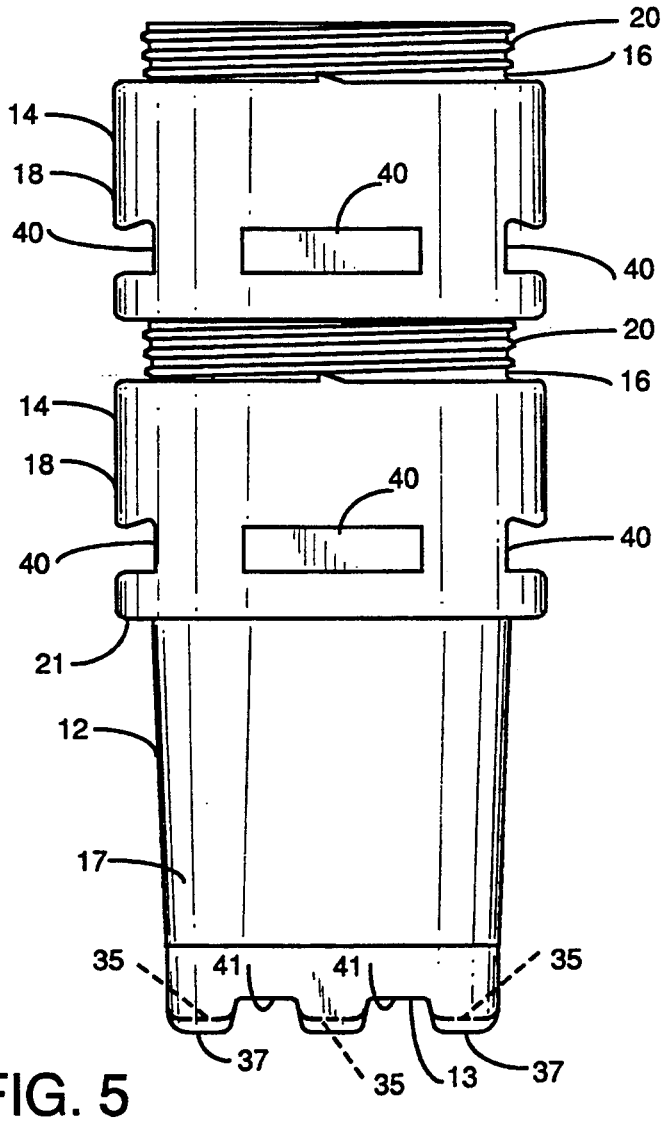
FIG. 5 is a view in side elevation showning two of the empty containers of FIGS. 2 or 3 nested in stacked relationship.

With particular reference to FIG. 5, the lower side wall portions 12 of containers 11 tapered outwardly from bottom wall 13 up to annular shoulder 21 to provide nesting capability for containers 11 when they are stacked together in an empty condition.

The containers 11 and lids 22 are blow molded of high density/high molecular weight thermoplastic. In particular they are preferably molded of polyethylene thermoplastic.

With particular reference to FIGS. 1, 2 and 3, lid 22 is also provided on its top side 23 with perimetrical upstanding castellations 45 having gaps 46 therebetween for lever access, such as with a two-by-four and the like, to assit in screw tightening or loosening of lid 22 onto container 11.

Lid 22 is also provided with conventional depressions or dimpling 47 to assit in strengthening top wall 23.

With particular reference to FIG. 4, details of the threaded connection between lid 22 and container 11 are illustrated. In particular annular ring seal 48 is shown and provides a leak-proof seal between lid 22 and container 11.

I claim:

1. A blow molded container and hollow closure therefore comprising:

a container having a side wall and circular bottom wall, said side wall having an exterior surface, an interior surface, an upper side wall portion, a lower side wall portion, and an enlarged diameter side wall portion intermediate the upper and lower side wall portions, the exterior surface of the upper side wall portion being provided with male threads, said container having an annular shoulder formed between the lower side wall portion and the enlarged sidewall portion;

a lid having a double-walled top body and a double-walled annular skirt depending downwardly from the double-walled top body, said skirt having an interior circumferential surface and an exterior circumferential surface, the interior circumferential surface of said skirt being provided with female threads for mating witht he male threads of said container;

said container being presized to contain a salvage drum therein of conventional size; and override lid lock means between a bottom edge portion said lid skirt and a top edge portion of said container for locking said lid onto said container when fully threaded thereon.

2. The container and closure combination of claim 1 wherein said lid has a top side and an underside and drum retainer means including a downwardly extending protrusion on the underside of said lid for engaging the upper end of a salvage drum to be received in said container when said lid is fully screwed on said container for engaging and confining a salvage drum in said container between said bottom and said lid when said lid is threadably received on said container.

3. The container and closure combination of claim 2 wherein said protrusion is in the shape of an annular ring.

4. The container and closure combination of claim 3 wherein said protrusion is slightly larger in diameter than a drum top to be retained in said container and includes an inwardly sloped or tapered annular wall for engaging the upper perimeter of a drum.

5. The container and closure combination of claim 1 wherein said override lock means includes at least one protruding ramp and a corresponding lock notch for receiving said ramp.

6. The container and closure combination of claim 1 wherein center portions of said container bottom are upwardly recessed from perimeter portions of said bottom when said container is empty such that said perimeter portions only of said container bottom will rest on an underlying surface for stabilizing the container when resting empty in an upright position.

7. The container and closure combination of claim 1 including a parallel pair of horizontal recesses on opposite sides of said container in the exterior surface of said enlarged diameter side wall portion for receiving forks of a forklift for lifting and moving said container by forklift.

8. The container and closure combination of claim 1 including a spaced parallel pair of forklift access recesses on the bottom of said container for receiving forks of a forklift for lifting and moving said container from the bottom thereof by forklift.

9. The container and closure combination of claim 1 wherein said lid has a top side and a bottom side and said top side is recessed to receive and seat the bottom of another one of said container for stacking.

10. The container and closure combination of claim 9 wherein said lid top side is provided with perimetrical upstanding castellations with gaps therebetween for lever access to assist in screw tightening or loosening of said lid on said container.

11. The container and closure combination of claim 1 wherein said lower side wall portion is tapered outwardly from said bottom wall to said annular shoulder for nesting containers together when stacking.

12. The container and closure combination of claim 1 wherein said container and lid are blow molded of high density/high molecular weight thermoplastic.

13. The container and lid combination of claim 12 wherein said thermoplastic is polyethylene.

14. A blow molded container and lid combination comprising:

a container having a side wall and circular bottom wall, said side wall having an exterior surface, an interior surface, an upper side wall portion, a lower side wall portion, and an enlarged diameter side wall portin intermediate the upper and lower side wall portions, the exterior surface of the upper side wall portion being provided with male threads, said container having an annular shoulder formed between the lower side wall portion and the enlarged side wall portion;

a lid having a top with an upper side and an underside and an annular skirt depending downwardly from said top, said skirt having an interior circumferential surface and an exterior circumferential surface, the interior circumferential surface of said skirt being provided with female threads for mating with the male threads of said container;

a spaced parallel pair of forklift access recesses on the bottom of said container for receiving forks of a forklift for lifting and moving said container from the bottom thereof by forklift, and a parallel pair of horizontal recesses on opposite sides of said container in the exterior surface of said enlarged diameter side wall portion for receiving forks of a forklift for lifting and moving said container by forklift.

15. The container and lid combination of claim 14 wherein said lid top is double-walled and said annular skirt is double-walled.

16. The container and lid combination of claim 15 including a downwardly extending protrusion on the underside of said lid for engaging the upper end of a salvage drum to be received in said container when said lid is fully screwed on said container.

17. The container and lid combination of claim 16 wherein said protrusion is in the shape of an annular ring.

18. The container and lid combination of claim 17 wherein said protrusion is slightly larger in diameter than a drum top to be retained in said container and includes an inwardly sloped or tapered annular wall for engaging the upper perimeter of a drum.

19. The container and lid combination of claim 14 including override lid lock means between said lid skirt and said container for locking said lid onto said containr when fully threaded thereon.

20. The container and lid combination of claim 19 wherein said override lock means is positioned between a bottom edge portion of said lid skirt and a top edge portion of said container, and includes at least one protruding lock ramp and a corresponding lock notch for receiving said ramp.

21. The container and lid combination of claim 14 wherein center portions of said container bottom are upwardly recessed from perimeter portions of said bottom when said container is empty such that said perimeter portions only of said container bottom will rest on an underlying surface for stabilizing the container when resting empty in an upright position.

22. The container and lid combination of claim 14 wherein said upper side of said lid is recesssed to receive and seat the bottom of another one of said container for stacking.

23. The container and lid combination of claim 22 wherein said lid top side is provided with perimetrical upstanding castellations with gaps therebetween for lever access to assist in screw tightening or loosening of said lid on said container.

24. The container and lid combination of claim 14 wherein said lower side wall portion is tapered outwardly from said bottom wall to said annular shoulder for nesting containers together when stacking.

25. The container and lid combination of claim 14 wherein said container and lid are blow molded of high density/high molecular weight thermoplastic.

26. The container and lid combination of claim 25 wherein said thermoplastic is polyethylene.

* * * * *